US005143595A

United States Patent [19]

Thomas et al.

[11] Patent Number: 5,143,595

[45] Date of Patent: Sep. 1, 1992

[54] PREPARATION OF OXIDATION-STABLE AND LOW-TEMPERATURE-STABLE BASE OILS AND MIDDLE DISTILLATES

[75] Inventors: Juergen Thomas, Fussgoenheim; Roland Spahl, Lorsch; Thomas Anstock, Weisenheim; Ansgar Eisenbeis, Georgsmarienhuette; Wolfgang Schmid, Wallenhorst, all of Fed. Rep. of Germany

[73] Assignee: BASF Aktiengesellschaft, Ludwigshafen, Fed. Rep. of Germany

[21] Appl. No.: 654,883

[22] Filed: Feb. 1, 1991

[30] Foreign Application Priority Data

Feb. 3, 1990 [DE] Fed. Rep. of Germany ..... 4003175

[51] Int. Cl.[5] ..... C10G 69/00

[52] U.S. Cl. ..... 208/58; 208/59; 208/95; 208/100; 208/109; 208/110; 208/111; 208/143; 208/144

[58] Field of Search ..... 208/58, 59, 95, 100, 208/109, 110, 111, 143, 144

[56] References Cited

U.S. PATENT DOCUMENTS 4,347,121 8/1982 Mayer et al. ..... 208/58
4,561,967 12/1985 Miller ..... 208/120

FOREIGN PATENT DOCUMENTS 279180 8/1988 European Pat. Off. .
2613877 10/1976 Fed. Rep. of Germany ;
8901506 2/1989 World Int. Prop. O. .

*Primary Examiner*—Theodore Morris
*Assistant Examiner*—William C. Diemler
*Attorney, Agent, or Firm*—John H. Shurtleff

[57] ABSTRACT

A process for the preparation of a base oil and middle distillate which is stable to oxidation and low temperature from a mineral oil fraction having a boiling range above 350° C., by, in a first step, converting the mineral oil fraction on a hydrocracking catalyst under hydrocracking conditions to an extent of from 20 to 80% by weight into fractions which boil below 360° C., separating the reactor effluent, if necessary, into liquid and gas phases in a high-pressure separator, treating the entire reactor effluent or only the liquid phase, directly or after removal of the fractions boiling below 360° C. by distillation, in a second step with hydrogen at from 200° to 450° C. and at from 20 to 150 bar in the presence of a catalyst which contains a crystalline pentasil-type borosilicate zeolite, alumina and/or amorphous alumosilicate as the carrier material and one or more metals from Group VIb and/or Group VIII of the Periodic Table and phosphorus, and, after distillation of the hydrogenation product, obtaining a middle distillate in the boiling range from 180° to 360° C. having a pour point of below −30° C. and an oxidation-stable residue having a boiling point >360° C., a viscosity index of from 110 to 135 and a pour point of below −12° C.

6 Claims, No Drawings

PREPARATION OF OXIDATION-STABLE AND LOW-TEMPERATURE-STABLE BASE OILS AND MIDDLE DISTILLATES

The present invention relates to the preparation on the one hand of middle distillates in the boiling range from 180° to 360° C. and on the other hand an oxidation-stable residue which is suitable as a base oil for lubricant oils, by treating mineral oil fractions having a boiling range above 350° C. in a first step by hydrocracking and in a second step by hydrogenation using a catalyst based on a borosilicate zeolite.

The constant further development of engine oils makes ever-increasing demands on the base oils on which these engine oils are based. The preparation of fuel-saving low-viscosity engine oils requires the provision of base oils which have low viscosity down to low temperatures and thus prevent cold-start wear, and which remain sufficiently viscous at high temperatures to ensure adequate lubrication. A slight dependence of the viscosity on the temperature and thus a high viscosity index (VI) is therefore necessary. Further important quality requirements of base oils are oxidation stability and adequate fluidity at low temperatures.

VHVI (very high viscosity index) base oils can be attained by hydrocracking vacuum gas oils, where low VI components are either cracked to form low-boiling components or converted into high VI compounds by hydrogenation, ring opening or isomerization.

A subsequent dewaxing has the purpose of improving the fluidity at low temperatures. In this operation, long-chain, unbranched and only slightly branched hydrocarbons are removed, either by physical means by deposition of paraffin crystals at low temperatures using a mixture of solvents or by hydrogenative chelating compounds on shape-selective catalysts. The fluidity is assessed, for example, by determining the pour point in accordance with DIN 51 597.

The oxidation stability can be modified by subsequent hydrogenation of the base oil or by adding stabilizers, and can be tested, for example, in accordance with DIN 51 352 from the increase in the carbon residue by the method of Conradson after ageing while passing air through the oil.

U.S. Pat. No. 4,347,121 describes a process in which successive hydrocracking, hydrofinishing and catalytic dewaxing give base oils for lubricant-oil production which have viscosity indices of about 100, are stable to oxidation and have adequate fluidity at low temperatures.

U.S. Pat. No. 4,561,967 relates to a one-step catalytic process for the preparation of light neutral oils of good UV stability using hydrocracking products.

German Patent 2,613,877 relates to a process for the preparation of lubricant oil in which two hydrocracking steps and a catalytic dewaxing step give lubricant oils of low pour point and a VI of 95.

The viscosity index of the base oil obtained in all these processes is not thought to be adequate for the preparation of high-quality lubricant oil.

It is therefore an object of the present invention to propose a process for the preparation of oxidation-stable VHVI oil.

We have found that this object is achieved by a two-step process for the preparation of oxidation-stable base oils having a VI of from 110 to 135 (VHVI oils) and very good fluidity at low temperature, by converting heavy mineral oil fractions having a boiling range above 350° C. on a hydrocracking catalyst under hydrocracking conditions to an extent of from 20 to 80% by weight into fractions which boil below 360° C., separating the reactor effluent, if necessary, into liquid and gas phases in a high-pressure separator, treating the entire reactor effluent or only the liquid phase, directly or after removal of the fractions boiling below 360° C. by distillation, in a second step with hydrogen at from 200° to 450° C. and at from 20 to 150 bar in the presence of a catalyst which contains a crystalline pentasil-type borosilicate zeolite, alumina and/or amorphous alumosilicate as the carrier material and one or more metals from Group VIb and/or Group VIII of the Periodic Table and phosphorus, and, after distillation of the hydrogenation products, obtaining a middle distillate in the boiling range from 180° to 360° C. having a pour point of below −30° C. and an oxidation-stable residue having a boiling point >360° C., a viscosity index of from 110 to 135 and a pour point of below −12° C.

The first step is generally carried out at from 40 to 150 bar, at from 300° to 450° C. and at a weight hourly space velocity of from 0.1 to 4 kg/l×h using hydrogen in the presence of a catalyst whose carrier preferably comprises alumina, an amorphous alumosilicate and/or a dealuminated Y-zeolite and contains, as the hydrogenation component, one or more metals from Group VIb and/or VIII of the Periodic Table and phosphorus. All the liquid effluent from the first step is fed directly, without decompression, to the second step or, after removal of the fractions boiling below 360° C., treated at, for example, from 20 to 150 bar, at, for example, from 200° to 450° C. and at a weight hourly space velocity of from 0.1 to 4 kg/l×h, with hydrogen in the presence of a catalyst which contains a pentasil-type borosilicate zeolite in addition to alumina and/or alumosilicate or silica. The oils are stabilized against hydrogenation by treating the catalyst with one or more metals from Group VIb and/or VIII of the Periodic Table.

The viscosity index of from 110 to 135 in the base oil having a boiling point >360° C. is established in the first step by means of various degrees of conversion, which is the quotient of the fraction boiling below 360° C. and the total hydrocarbon fraction. In the 2nd step, the reaction conditions (pressure, temperature and weight hourly space velocity) and selected in such a manner that the resultant base oil, which starts to boil at above 360° C., is stable to oxidation and has a poor point below −12° C.

A further surprising advantage of the process according to the invention is the finding that the base oils from the process respond to pour-point improvers better than those dewaxed using solvents.

In addition, the middle distillates in a boiling range of from 180° to 360° C. produced in this process have excellent low-temperature properties. The pour point is in all cases below −30° C. Middle distillates of this type are valuable mixing components for the production of low-temperature-stable diesel fuels.

Catalysts for the hydrocracking step of the process according to the invention can be prepared by mixing an alumina component with a silica component or an alumosilicate, with or without addition of a dealuminated Y-type zeolite having a molar $SiO_2$:$Al_2O_3$ ratio in the range from 7 to 150, and a peptizer, for example formic acid. A particularly suitable $SiO_2$ component is a hydrogel having an $SiO_2$ content of 10 to 20% by weight, characteristic bands in the IR spectrum at wave numbers of 1630 and 960 $cm^{-1}$, a sodium content of less than 0.01% by weight and a BET surface area of greater than 400 $m^2/g$. The dealumination of the Y-zeolite can be effected by acid treatment, for example by the method of German Patent 2,435,716. The amorphous carrier components employed may be from 20 to 95% by weight, preferably from 30 to 60% by weight, of alumina and from 5 to 50% by weight, preferably from 20 to 40% by weight, of silica. The proportion by weight of the de-aluminated Y-zeolite in the carrier may be varied in the range from 0 to 30. After rigorous mixing, the paste is extruded through a die having a diameter of from 1 to 3 mm, subsequently dried and calcined at elevated temperature.

The composition of the carrier of the catalyst employed in the 2nd step, the dewaxing and stabilization, of the process according to the invention may expediently be varied in the range of 10 to 90% by weight of pentasil-type borosilicate zeolite, from 10 to 90% by weight of alumina and 20 to 40% by weight of silica.

The pentasil-type borosilicate zeolite used has a high $SiO_2$:$B_2O_3$ ratio and a pore size between that of type A zeolite and that of type X or Y zeolite. They are synthesized, for example, at from 90° to 200° C. under autogenous pressure by reacting a boron compound, for example $H_3BO_3$, with a silicone compound, preferably highly dispersed silica, in aqueous amine solution, in particular in 1,6-hexanediamine, 1,3-propanediamine or triethylenetetramine, with or, in particular, without added alkali metal or alkaline earth metal. These zeolites also include the isotactic zeolites of EP 34,727 and EP 46,504. They can also be prepared by carrying out the reaction in ether solution, for example diethylene glycol dimethyl ether, or in alcoholic solution, for example in 1,6-hexanediol, instead of aqueous amine solution. An essential and particularly advantageous synthesis of the borosilicate zeolite is in aqueous polyamine solution without addition of alkali. The zeolites prepared in this way can, after isolation, drying at from 100° C. to 160° C., preferably at 110° C., and calcination at from 450° to 550° C., preferably 500° C., be shaped together with other carrier materials.

The hydrogenation component for the catalyst in both steps of the process according to the invention can be incorporated into the moist carrier mixture and/or applied to the catalyst support by impregnation. The catalyst particles are to this end brought into contact one or more times with, for example, a solution which contains the desired hydrogenation component. The amount of solution corresponds to the previously determined water absorption capacity of the catalyst particles. Preferred hydrogenation-metal components are Co, Ni, Mo and W, for example in the form of ammonium heptamolybdate, nickel nitrate, ammonium metatungstate or cobalt nitrate. The finished catalyst is obtained after further drying and calcination and may contain from 2 to 10% by weight of nickel oxide or cobalt oxide and from 10 to 25% by weight of molybdenum or tungsten, calculated as $MoO_3$ and $WO_3$ respectively. The catalysts may also be mixed with phosphorus components, either during mixing of the carrier components or as a constituent of the impregnated solution. Usual amounts here are in the range of 1 to 12% by weight of $P_2O_5$, based on the finished catalyst.

Before they are used, the catalysts are converted from the oxidic form into the more-active sulfidic form by sulfurization, for example by passing a mixture of hydrogen and $H_2S$ over the catalyst.

Suitable feedstocks for the process are heavy gas oils, vacuum gas oils, deasphalted residual oils and mixtures thereof in the boiling range above 350° C. Prior degradation of the organic sulfur and nitrogen compounds is not necessary, but is advantageous in certain cases.

In detail, an expedient procedure involves introducing the feedstock together with hydrogen into the hydrocracking reactor and heating the mixture to the reaction temperature. The conversion rate for a boiling temperature <360° C. is set at from 20 to 80%. The effluent from the hydrocracking reactor is separated into liquid and gas phases in a high-pressure separator. Ammonia and hydrogen sulfide present in the gas phase may be removed in a downstream scrubber, and the hydrogen is fed back into the reaction zone. The liquid component is fed at the same pressure level to the second reactor, where dewaxing and hydrostabilization take place. If the sulfur content in the liquid component is less than 100 mg/kg, addition of a sulfur component, for example dimethyl disulfide (DMDS), before entry into the second reactor is necessary to prevent desulfurization of the catalyst. After the gas phase has been separated off in a further high-pressure separator, the effluent from the second reactor is separated in a downstream distillation step into liquid gas, naphtha, middle distillate and a residue with a boiling point >360° C. The residue, due its viscosity index of 110 to 135, its oxidation stability and its pour point of below −12° C., is highly suitable as a base oil for the production of high-quality lubricant oils. It was also observed that the base oils obtained by the process according to the invention respond to pour-point improvers very much better than, for example, base oils dewaxed using solvents. Not only smaller amounts of pour-point improvers required to produce a prespecified pour point, but also lower pour points can be achieved than was possible by conventional processes.

The fact that, in the present process, the middle distillates in the boiling range from 180° to 360° C. are not separated off until after the dewaxing step results in these middle distillates having excellent low-temperature properties. With a pour point <−30° C., the distillates also satisfy extreme requirements, for example for diesel fuel used during winter.

The process conditions for the two catalytic steps may generally be varied within the following ranges:

| | Hydrocracking (1st Step) | Dewaxing (2nd Step) |
|---|---|---|
| $H_2$ Pressure (bar) | 40–150 | 20–150 |
| WHSV (kg/l × h) | 0.1–4.0 | 0.1–4.0 |
| Temperature (°C.) | 300–450 | 200–450 |
| Gas/Oil (l(s.t.p.)/l | 100–2000 | 50–1000 |

EXAMPLE 1

Preparation Of The Catalyst For The Hydrocracking Step

A moist carrier mixture is prepared by mixing 227 g of hydrogel ($SiO_2$ content 15%) with 102 g of alumina and 10 g of formic acid with addition of 18 g of phosphoric acid, 16.2 g of nickel nitrate and 309 g of ammonium heptamolybdate dissolved in 150 ml of water. The carrier mixture is extruded through a 1.5 mm die, subsequently dried at 150° C. and calcined at 500° C. for 5 hours. The moldings are impregnated with a solution comprising nickel nitrate and ammonium heptamolybdate, and again dried and calcined. The finished catalyst has the following composition (% by weight): $Al_2O_3$ 51, $SiO_2$ 17, $MoO_3$ 18, NiO 5, $[PO_4]^{3-}$ 9.

EXAMPLE 2

Preparation Of The Catalyst For The Dewaxing And Hydrostabilization

Synthesis of the borosilicate zeolites:

A pentasil-type borosilicate zeolite is prepared in a hydrothermal synthesis from 640 g of highly disperse $SiO_2$, 122 g of $H_3BO_3$, 8000 g of an aqueous 1,6-hexanediamine solution (50:50 % by weight mixture) at 170° C. under autogenous pressure in a stirred autoclave without addition of alkali. The crystalline reaction product is filtered off and washed, dried at 100° C. for 24 hours and calcined at 500° C. for 24 hours. This borosilicate zeolite has the following composition: 94.2% by weight of $SiO_2$ and 2.3% by weight of $B_2O_3$ (ignition loss: 3.5% by weight).

The catalyst was prepared as described in Example 1 with addition of the borosilicate zeolite. The finished catalyst had the following composition (% by weight): $Al_2O_3$=18, boropentasil zeolite=60, $MoO_3$=18, NiO=4.

For this example, a vacuum gas oil from Amna, Sahara, having the following properties, was employed:

| | |
|---|---|
| Density, 15° C. | 0.894 g/ml |
| Viscosity, 70° C. | 14.6 $mm^2/s$ |
| Pour point | 40° C. |
| Sulfur content | 0.34% by weight |
| Nitrogen content | 0.081% by weight |
| C aromatic according to Brandes | 16.5% by weight |
| Boiling-point curve ASTM D 1160 | |
| Commencement of boiling | 260° C. |
| 10% by volume | 373° C. |
| 30% by volume | 432° C. |
| 50% by volume | 455° C. |
| 70% by volume | 480° C. |
| 90% by volume | 516° C. |
| End of boiling | 548° C. |

| Reaction conditions: | Hydrocracking (1st Step) | Dewaxing (2nd Step) |
|---|---|---|
| $H_2$ Pressure (bar) | 100 | 70 |
| WHSV (kg/l × h) | 0.4 | 0.7 |
| Temperature (°C.) | 405 | 320 |
| Gas/Oil (l(s.t.p.)/l | 1000 | 500 |

After the hydrocracking step, the gaseous constituents were separated off in a high-pressure separator, and all the liquid components were fed to dewaxing.

| Product yields (% by weight): | |
|---|---|
| $H_2S + NH_3$ | 0.5 |
| $C_1 + C_2$ | 1.0 |
| $C_3 + C_4$ | 12.2 |
| $C_5$ – 80° C. | 15.7 |
| 80–180° C. | 11.2 |
| 180–360° C. | 26.3 |
| >360° C. | 35.2 |

-continued

| Product properties: | |
|---|---|
| Middle distillate 180–360° C. | |
| Density, 15° C. | 0.842 g/ml |
| Cetane index | 51 |
| Pour point | −42° C. |
| C aromatic according to Brandes | 9.5% by weight |
| Fraction >360° C. | |
| Density, 15° C. | 0.846 g/ml |
| Pour point | −13° C. |
| Viscosity, 100° C. | 4.8 $mm^2/s$ |
| Viscosity index | 119 |
| Increase in the carbon residue in accordance with DIN 51 352 | <1.2% |

We claim:

1. A process for the preparation of a base oil and middle distillate which is stable to oxidation and low temperatures from a mineral oil fraction having a boiling range above 350° C., which comprises:

in a first step, converting the mineral oil fraction on a hydrocracking catalyst under hydrocracking conditions at a pressure of 40 to 150 bar and a temperature of 300° to 450° C., to an extent of from 20 to 80% by weight into fractions which boil below 360° C., separating the reactor effluent, if necessary, into liquid and gas phases in a high-pressure separator; and in a second step, treating the entire reactor effluent or only the liquid phase, directly or after removal of the fractions boiling below 360° C. by distillation, with hydrogen at form 200° to 450° and at from 20 to 150 bar in the presence of a catalyst which contains a crystalline pentasil borosilicate zeolite, alumina and/or amorphous alumosilicate as the carrier material and one or more metals from Group VIb and/or Group VIII of the Periodic Table and phosphorus, and, after distillation of the hydrogenation product, obtaining a middle distillate in the boiling range from 180° to 360° C. having a pour point of below −30° C. and an oxidation-stable residue having a boiling point >360° C., a viscosity index of from 110 to 135 and a pour point of below −12° C.

2. A process as claimed in claim 1, wherein the hydrocracking catalyst contains from 1 to 40% by weight of dealuminated Y zeolite having an $SiO_2$:$Al_2O_3$ molar ratio in the range form 7 to 150.

3. A process as claimed in claim 1, wherein the proportion of crystalline borosilicate zeolite in the catalyst in the second step is from 1 to 90% by weight.

4. A process as claimed in claim 3, wherein the $SiO_2$ component in the borosilicate zeolite is a hydrogel having an $SiO_2$ content of from 10 to 20% by weight, characteristic bands in the IR spectrum at wave numbers of 1630 and 960 $cm^{-1}$, a sodium content of less than 0.01% by weight and a BET surface area of >400 $m^2/g$.

5. A process as claimed in claim 1, wherein the entire reactor effluent from the hydrocracking step, comprising liquid and gas phases, is fed to the second step.

6. A base oil product obtained as the residue of the process according to claim 1.

* * * * *